US005949274A

United States Patent [19]

Stanchak

[11] Patent Number: 5,949,274

[45] Date of Patent: Sep. 7, 1999

[54] HIGH IMPEDANCE BIAS CIRCUIT FOR AC SIGNAL AMPLIFIERS

[75] Inventor: Carl M Stanchak, Colorado Springs, Colo.

[73] Assignee: Atmel Corporation, San Jose, Calif.

[21] Appl. No.: 08/935,405

[22] Filed: Sep. 23, 1997

[51] Int. Cl.[6] ..... G05F 1/10

[52] U.S. Cl. ..... 327/530; 327/87; 327/540; 327/541

[58] Field of Search ..... 323/313; 327/56, 327/77, 88, 89, 87, 538, 530, 540, 541, 543

[56] References Cited

U.S. PATENT DOCUMENTS

| | | | |
|---|---|---|---|
| 4,264,874 | 4/1981 | Young | 330/277 |
| 4,396,883 | 8/1983 | Holloway et al. | 323/313 |
| 5,168,209 | 12/1992 | Thiel | 323/313 |
| 5,317,280 | 5/1994 | Zimmer et al. | 330/261 |
| 5,467,052 | 11/1995 | Tsukada | 327/543 |
| 5,570,060 | 10/1996 | Edwards | 327/538 |
| 5,592,121 | 1/1997 | Jung et al. | 327/538 |
| 5,598,122 | 1/1997 | McClure | 327/538 |
| 5,805,010 | 9/1998 | Wu | 327/538 |

*Primary Examiner*—Timothy P. Callahan
*Assistant Examiner*—Jung Ho Kim
*Attorney, Agent, or Firm*—Thomas Schneck; Rosalio Haro

[57] ABSTRACT

The present invention discloses an integrated constant bias voltage generator using only active devise to simulate a high impedance node, as seen from a capacitively coupled input signal. A reference current source an MOS device are coupled in series between Vcc and ground with the drain electrode of the MOS device being the constant bias voltage output. An input signal capacitively coupled to said drain electrode introduces an error current monitored by a current monitoring means. A feedback means responsive to the current monitoring means modulates the control input of the MOS device to select a IDS vs. VDS characteristic curve which will maintain the VDS voltage constant for any given IDS current, including the error current. The feedback means also compensates for voltage fluctuations in Vcc.

34 Claims, 6 Drawing Sheets

HIGH IMPEDANCE BIAS CIRCUIT FOR AC SIGNAL AMPLIFIERS

TECHNICAL FIELD

The present invention relates to integrated circuits using active devices to generate a high impedance node, and more particularly to the use of such high impedance nodes in bias voltage generating circuits.

BACKGROUND ART

There are many types of voltage amplifiers, but all share similar characteristics and similar limitations. For illustrative purposes, FIG. 1 shows the internal structure of a basic amplifier 11. A typical amplifier 11 has an input signal $V_{IN}$ at an input node 15 and an output signal $V_{OUT}$ at an output node 17.

$V_{OUT}$ is a function of $V_{IN}$ determined by the internal structure of amplifier 11. In the present example, input signal $V_{IN}$ is internally coupled to the control gate of an nmos transistor 13. Nmos transistor 13 is coupled between a constant current source 21 and ground with its drain 18 connected to the output of current source 21 and to output node 17. As $V_{IN}$ is varied, the voltage drop from source 19 to drain 18 responds by varying 180° out of phase with $V_{IN}$ and having an amplitude gain determined by the architectural characteristics of transistors 13 and by the load line of amplifier 11. The load line of amplifier 11 is determined by the load at drain 18 and the voltage value of Vcc, which is typically 3V to 5V. One generally has no control over power supply Vcc variations, nor can one generally vary the architectural characteristics of transistor 13 after it has been manufactured. As shown, the only load coupled to drain 18 is current source 21. Thus, being able to select and maintain an accurate current value for current source 21 is an important criteria in maintaining a stable, predetermined gain for amplifier 11.

FIG. 2 shows amplifier 11 with a typical implementation of a current source. In FIG. 2, the current source consists of a pmos transistor 23 having its source electrode 25 coupled to Vcc, its drain electrode 27 coupled to drain 18 of transistor 13 and its gate 26 coupled to a reference voltage $V_{REF}$. Due to structural and layout constraints, input signal $V_{IN}$ will generally also be coupled to reference signal $V_{REF}$ via an intrinsic coupling capacitor 29. As will be explained below, this can degrade the performance of amplifier 11.

With reference to FIG. 3, an enhancement mode transistor, such as pmos transistor 23 is characterized by a source-to-drain current, $I_{DS}$, versus source-to-drain voltage, $V_{DS}$, curve 31. Typically, the $I_{DS}$ vs. $V_{DS}$ curves of pmos transistors have an opposite polarity as those of nmos transistors. For the sake of clarity, all references to $I_{DS}$, $V_{DS}$ and $V_{GS}$ refer to their magnitudes only, and not to their polarity such that the following discussion applies equally to pmos and nmos devices.

At a given source-to-gate voltage, $V_{GS}$, within the saturation region, variations $\Delta i$ in the source-to-drain current $I_{DS}$ are relatively small over a larger change $\Delta v$ in the source-to-drain voltage $V_{DS}$. This $I_{DS}$ vs $V_{GS}$ behavior will be identified as the transistor action of a switch transistor in the remainder of this application. Since $I_{DS}$ current remains relatively stable over a large $V_{DS}$ range, an enhancement mode MOS transistor operating in the saturation region is known in the art as a good current source. The saturation current, as well as the saturation mode of an MOS transistor, is selected by $V_{GS}$. If $V_{GS}$ varies, the saturation current of transistors 23 will change, and transistor 23 may even fall out of saturation. Since the gain of amplifier 11 of FIG. 2 is dependent on a steady saturation current from transistor 23, it is important that reference voltage $V_{REF}$, i.e. $V_{GS}$ in FIG. 3, be supplied by a constant voltage source.

With reference to FIG. 4, a good constant voltage source, such as a battery, experiences small voltage fluctuations $\Delta v$ over a large current range $\Delta i$. As explained above in FIG. 3, the transistor action of a switch MOS device in its saturation region has the opposite characteristic of a large voltage fluctuation $\Delta v$ over a small current change $\Delta i$. Therefore, this transistor action of an MOS transistor has traditionally not been suitable for generating a constant voltage source. A battery, however, is not available in an integrated circuit. One therefore is limited to transistors, resistors and other integratable devices when constructing a constant voltage source in an integrated circuit. In order to avoid the shortcomings of the transistor action discussed above, transistors are typically connected to function as diodes.

With reference to FIG. 5, a typical IC prior art circuit of a constant voltage source is shown. Transistor 24 is diode connected with its gate 22 coupled to its drain 28 such that its $V_{GS}$ is equal to its $V_{DS}$. Diode connected transistor 24 is coupled in series with a current drain 35 between Vcc and ground. The reference voltage output, $V_{REF}$, is tapped at node 38, which connects drain electrode 28 to current drain 35.

Line 39 of plot 37 illustrates the relationship between $I_{DS}$ and $V_{GS}$ of diode connected transistor 24. As shown, device 24 follows a more diode-like curve and current variations $\Delta i$ result in less drastic voltage variations $\Delta v$ than in the transistor action curve of FIG. 3. Diode connected transistor 24 thus has a more gradual relationship between its $I_{DS}$ current and $V_{DS}$ voltage.

Nonetheless, the use of diode connected transistors offers only a partial solution. As shown in plot 37, $V_{DS}$ is still highly susceptible to fluctuations in $I_{DS}$, albeit to much lesser degree than before. A common method of reducing the susceptibility of $V_{DS}$ to $I_{DS}$ variations is to limit the amount of $I_{DS}$ current fluctuations $\Delta i$, and thereby limit $V_{DS}$ fluctuations $\Delta v$. Current fluctuations $\Delta i$ are typically introduced by input signal $V_{IN}$ via coupling capacitor 29.

With reference to FIG. 6, current fluctuations $\Delta i$ are traditionally limited by placing a large resistor 41 between node 38 and node 40, which connects to output signal $V_{REF}$ and coupling capacitor 29. The large resistance of resistor 41 reduces the amount of current introduced by $V_{IN}$ and thereby mitigates the amount of current fluctuations $\Delta i$ through diode connected transistor 24. In order for resistor 41 to adequately reduce fluctuations in $V_{REF}$, it needs to be very large and typically has a value of many megaohms. The formation of such large resistors in an integrated circuit requires a large area. Furthermore, large resistors in ICs suffer from various problems including leakage current and a distributed intrinsic capacitance of their own. Both problems introduce additional current fluctuations which reduce the resistor's effectiveness. Additionally, the circuit of FIG. 6 does not address voltage variations in $V_{REF}$ due to power fluctuations in Vcc.

Several attempts have been made to reduce this reliance on large resistors in the construction of IC constant voltage sources and high impedance nodes. U.S. Pat. No. 5,467,052 to Tsukada discloses a voltage reference generating circuit resistant to power fluctuations. Tsukada discloses the use of a first resistor in a first branch and a second resistor in a second branch, with the current through the second branch being a ratio of the two resistors and of the characteristics of some of the transistors used. Because the current is dependent on a ratio, smaller resistors may be used. In a similar approach, U.S. Pat. No. 4,264,874 to Young discloses two inter-coupled current mirrors with a resistor connected between one branch of the current mirrors and ground. U.S. Pat. No. 5,317,280 to Zimmer et al. discloses a method of creating a high impedance node using PFETs and multiple smaller resistors. Zimmer et al. use a bootstrap technique to multiply the resistance of a bias impedance by the ratio of two smaller resistors.

These approaches reduce the size of required resistors, but do not eliminate their use. It is possible to establish an integrated voltage source without the use of resistors by using only diode connected transistors, as shown in FIG. 5. Such circuits, however, are easily influenced by the introduction of error currents and Vcc fluctuations, as explained above.

It is an object of the present invention to provide a constant voltage source using only active devices and which is not affected by error currents introduced by an input signal or by Vcc fluctuations.

It is another objective of the present invention to provide a circuit for simulating a high impedance node without the use of resistors.

It is yet another objective of the present invention to provide a constant voltage source insensitive to power, temperature and input signal variations, having a high impedance node not requiring resistors, and being suitable for an IC circuit.

SUMMARY OF THE INVENTION

The present objects are achieved in a circuit which simulates a high impedance node to maintain a constant voltage output over a varying error current. An active nonlinear device having a saturation region, such as a BJT, JFET or MOS transistor is used to simulate the high impedance node. A constant current source is used to generate a steady state current, $I_{XY}$*, through the nonlinear device and thereby establish a quiescent voltage drop, $V_{XY}$*, across the nonlinear device. Preferably, the $I_{XY}$* current generated by the constant current source is sufficient to place the active nonlinear device in its saturation region of operation. The active nonlinear device is characterized by a family of $I_{XY}$ vs. $V_{XY}$ curves describing the relationship between the current through it to the voltage across it for a given control input. That is, any characteristic curve of operation may be selected by means of the control input of the nonlinear device.

In operation, voltage fluctuations across the nonlinear device due to error currents through the nonlinear device are monitored by a characteristic curve selector circuit. As the $V_{XY}$ voltage begins to change due to the introduction of an error current, the characteristic curve selector circuit sends a compensating signal to the control input of the nonlinear device. The compensating signal selects a new characteristic curve for the nonlinear device. The new characteristic curve establishes a new $I_{XY}$' vs. $V_{XY}$' relationship for the nonlinear device which takes into account the addition of the error current to the steady state current from the current source. The new characteristic curve is selected such that the new voltage drop across the nonlinear device (corresponding to the steady-state current plus the error current) is substantially similar to its initial quiescent voltage drop $V_{XY}$*. The characteristic curve selector circuit thereby returns the new voltage drop $V_{XY}$' across the nonlinear device to its initial quiescent voltage value of $V_{XY}$* despite the introduction of an error current. In effect, the nonlinear device exhibits a vertical load line, maintaining a constant voltage output over a wide range of current values. The output voltage therefore remains relatively stable and unaffected by fluctuations in a capacitively coupled input signal. Since the voltage output remains constant, it effectively behaves as if it were isolated from the input signal by a large resistance, and thereby simulates a high impedance node.

In a preferred embodiment, error current fluctuations are indirectly monitored by noting a resultant voltage fluctuations at one of the nodes of the nonlinear device. This permits a secondary action of the present invention which allows it to compensate for Vcc fluctuations and sustain a constant voltage output. As explained above, the present invention can maintain a constant $V_{XY}$* voltage drop across its X and Y nodes over current fluctuations. However, since the present invention is powered off of Vcc and it maintains a constant voltage drop of $V_{XY}$* from Vcc, any voltage fluctuations in Vcc may be reflected at either of nodes X and Y, with respect to ground. Therefore, instead of monitoring $V_{XY}$ directly by probing across nodes X and Y, the present invention monitors only one of nodes X and Y. Since each node varies with variations in Vcc, the present embodiment can detect variations in Vcc and the characteristic curve selector will respond by modulating the control input of the nonlinear device to shift the vertical load line to a new operating point until a second $V_{XY}$" value is found which will restore the voltage at the monitored one of nodes X and Y back to its initial value.

BEST MODE OF CARRYING OUT THE INVENTION

Figure 1:
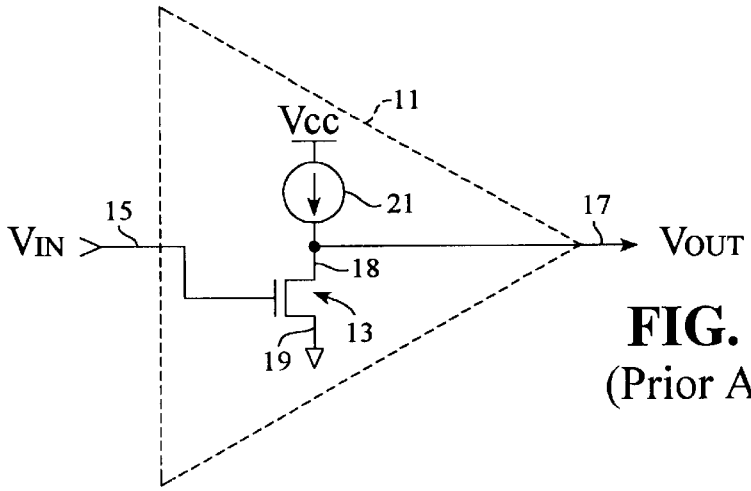
FIG. 1 (Prior Art)
FIGS. 1 and 2 are prior art voltage amplifiers.
Figure 2:
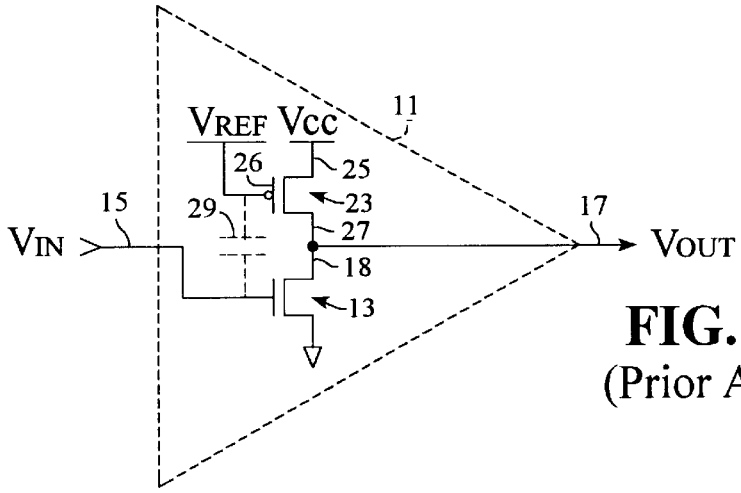
FIG. 2 (Prior Art)
Figure 3:
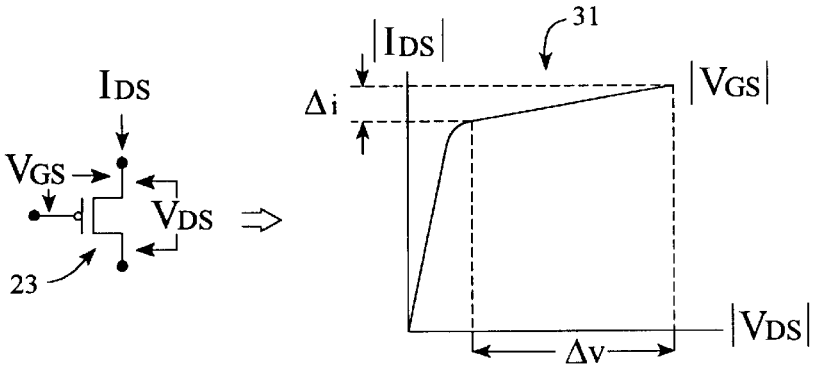
FIG. 3 (Prior Art)
FIG. 3 is an illustration of the current vs. voltage characteristics of a prior art MOS transistor.
Figure 4:
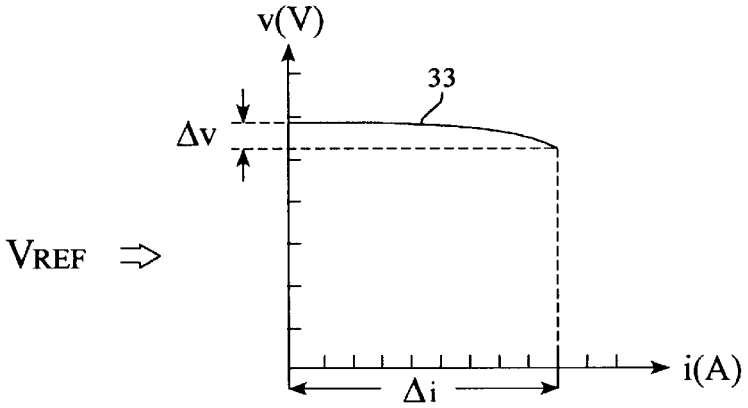
FIG. 4 (Prior Art)
FIG. 4 is an illustration of the voltage vs. current characteristics of a practical voltage source.
Figure 5:
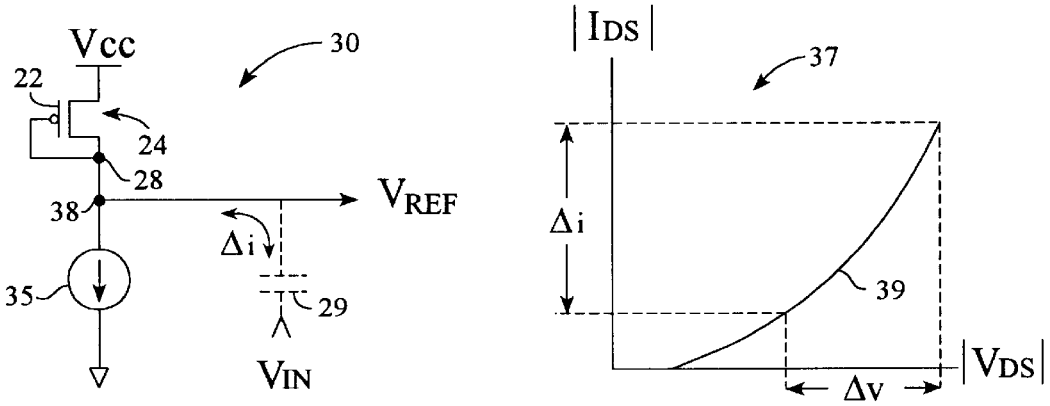
FIG. 5 (Prior Art)
FIG. 5 is a prior art constant voltage source.
Figure 6:
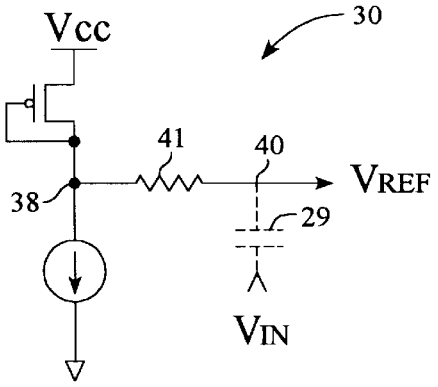
FIG. 6 (Prior Art)
FIG. 6 is a second embodiment of a prior art constant voltage source.
Figure 7:
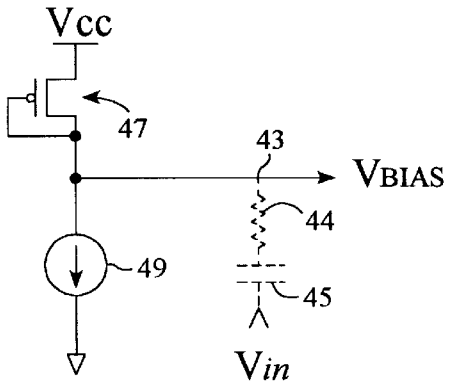
FIG. 7 is a symbolic representation of a circuit using an induced resistance in accord with the present invention.

The present invention moves away from the traditional approach of placing a resistor 41 between a voltage reference node 38 and an output node 40 coupled to an intrinsic capacitor 29, as shown in prior art FIG. 6. With reference to FIG. 7, the present invention instead seeks to introduce an induced high impedance 44 between an output node 43 and an intrinsic coupling capacitor 45. Since an input signal Vin is coupled to a constant voltage output signal $V_{BIAS}$ via intrinsic capacitor 45, the introduction of an induced high impedance 44 between $V_{BIAS}$ and capacitor 45 effectively isolates output signal $V_{BIAS}$ from input signal Vin. To generate an induced high impedance 44 in a practical IC circuit, however, the present invention abandons the conventional structure of a diode-connected transistor 47 in series with a current drain 49.

The present invention establishes a high impedance node without the use of resistors and using only active devices. Rather than limit the amount of error current being capacitively coupled to a voltage generating circuit by an input signal, the present invention allows the error current to flow freely. The present invention instead monitors all current fluctuations and adjusts the voltage generating circuitry to compensate for the current fluctuations.

Figure 8:
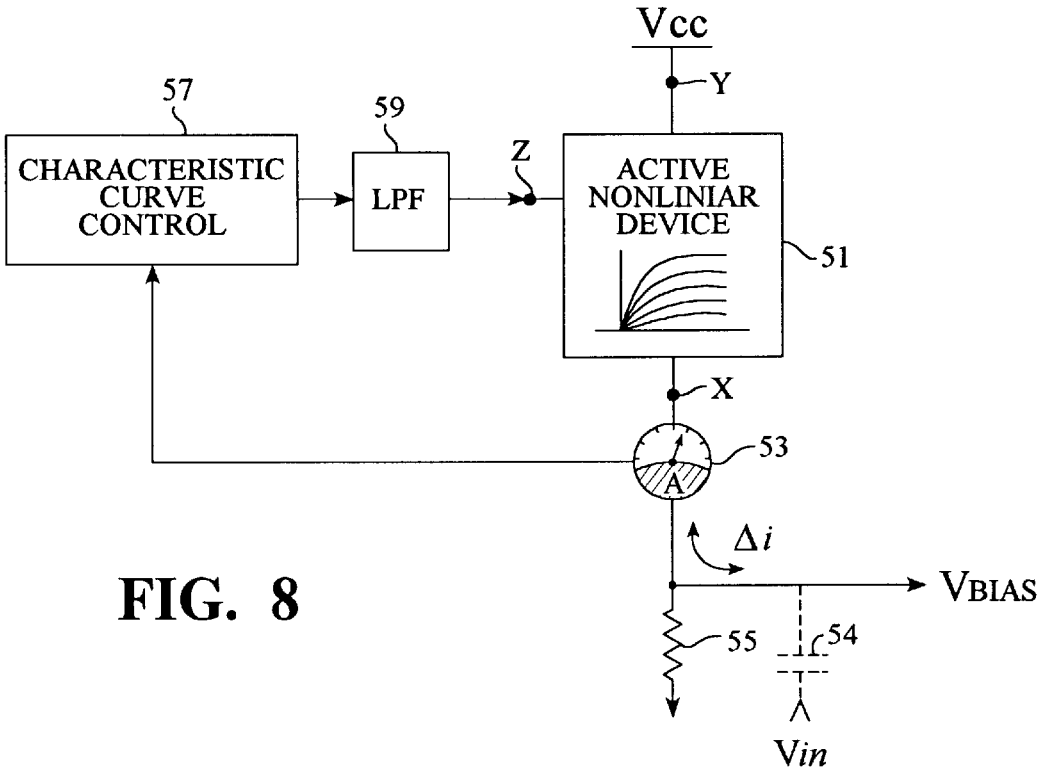
FIG. 8 is a circuit block of a first embodiment of the present invention.

With reference to FIG. 8, the present invention includes an active nonlinear device 51 having a first node Y coupled to Vcc, a second node X coupled to a current sensing element 53 and a third node Z to receive a control signal. Active nonlinear device 51 is characterized by a family of curves relating the voltage across nodes X and Y, $V_{XY}$, to the current through nodes X and Y, $I_{XY}$, at a given control input Z. Preferably, each of said curves is characterized by a linear ohmic region and a nonlinear saturation region. Active nonlinear device 51 may be one of a BJT, JFET or MOS transistor.

Active nonlinear device 51 is connected in series with a current drain 55 between Vcc and ground. In the present embodiment, current drain 55 is represented by a resistive element, but it would be understood that it may also be a constant current sink insensitive to temperature and voltage variations. The purpose of current drain 55 is to establish a current path from active nonlinear device 51 to ground through which a predetermined voltage may be developed across active nonlinear device 51.

An input signal Vin is allowed to freely introduce an error current Δi to output node $V_{BIAS}$ by means of coupling capacitor 54. A current sensing element 53 is placed between output node $V_{BIAS}$ and active nonlinear device 51 to monitor current therethrough. Current sensing element 53 has an output signal coupled to a characteristic curve control sub-circuit 57 which monitors for AC current variations and selects one of said family of curves which will maintain the voltage across nodes X and Y constant at any given current through nodes X and Y. The output from characteristic curve control 57 is applied through a low pass filter 59 to control input node Z. Low pass filter 59 stabilizes control of active nonlinear device 51 to filter out any momentary transients due to noise.

Figure 9:
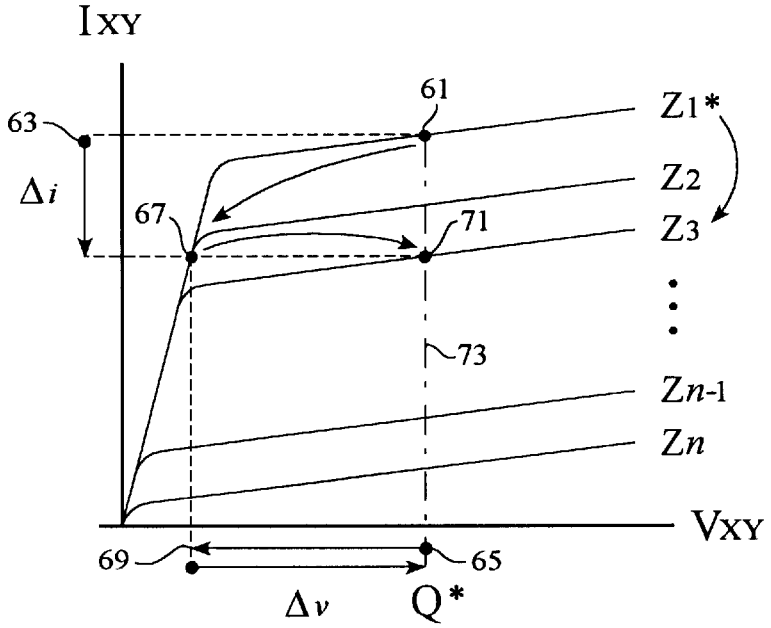
FIGS. 9 and 10 are graphical illustrations of the operation of an element within FIG. 8.

With reference to FIG. 9, a first operational example of the circuit of FIG. 8 is shown. FIG. 9 is a graph of current $I_{XY}$ through nodes X and Y versus voltage $V_{XY}$ across nodes X and Y for a given control signal Z. In the present example, Q* at point 65 represents a desired constant voltage drop across nodes X and Y resulting from an initial $I_{XY}$ current indicated by point 63 and an initial control signal Z1*. Quiescent voltage Q* is determined at an initial operating point 61 at the intersection of initial current point 63 and initial control signal Z1*. If an error current Δi were to cause current $I_{XY}$ to drop, the operating point along curve Z1* would tend to fall from point 61 toward point 67. This would typically be reflected in a more drastic drop in $V_{XY}$ from point 65 down toward point 69. To compensate for this reduction in voltage, characteristic curve control sub-circuit 57 of FIG. 8 would respond by adjusting Z to a new operating position Z3, which would effectively move the operating point of active non-linear device 51 from point 67 to point 71 and thereby restore voltage $V_{XY}$ back from point 69 to its initial position at point 65. Due to this modulation of control signal Z, active non-linear device 51 effectively demonstrates a vertical load line 73 wherein the voltage across nodes X and Y remains effectively constant over a wide range of current fluctuations Δi through nodes X and Y.

Figure 10:
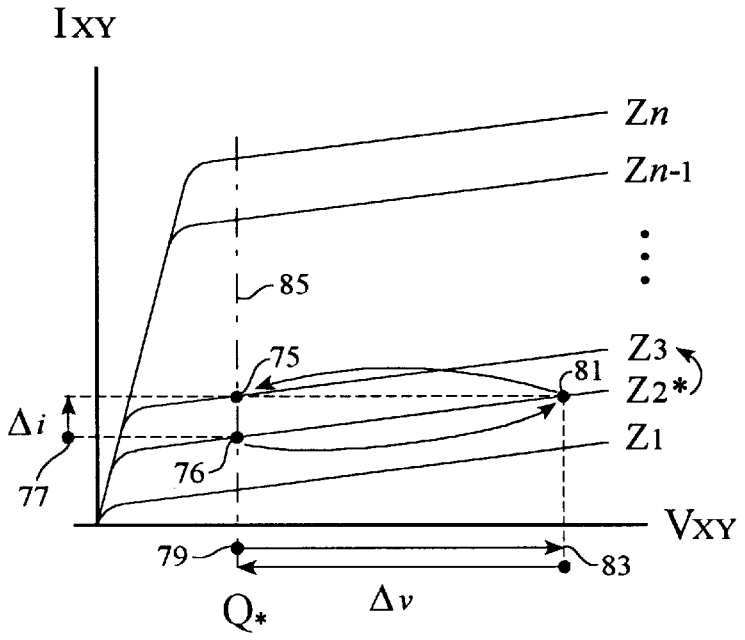

With reference to FIG. 10, a second operational example of the circuit of FIG. 8 is shown. In the present example, the operating point of the desired constant $V_{XY}$ voltage drop Q* at point 79 is indicated by operating point 76. As shown, operating point 76 corresponds to an initial operating current $I_{XY}$ at point 77 and an initial input control signal Z2*. If an error current is introduced and causes current $I_{XY}$ to increase by amount Δi, voltage $V_{XY}$ would tend to increase by an amount Δv from point 79 toward location 83 corresponding to a new operating point 81. Characteristic curve control sub-circuit 57 of FIG. 8, however, would modulate input control signal Z to a new operating position identified as Z3. This would establish a new operating point 75, and thereby return voltage $V_{XY}$ to its initial quiescent value Q* at point 79. Again, the device demonstrates a vertical load line 85.

Since the voltage across nodes X and Y remains insensitive to variations in Vin, the present invention effectively exhibits a high impedance node by using the saturation region of the transistor action of device 51. Contrary to the prior art which seeks to limit current fluctuations, the present invention instead modulates the voltage to current relation of nonlinear device 51 to maintain a constant voltage drop over a varying current. Thus, no large resistor is needed thereby eliminating the introduction of resistor leakage current and any additional intrinsic distributed capacitance, which can limit the frequency response of a device.

Figure 11:
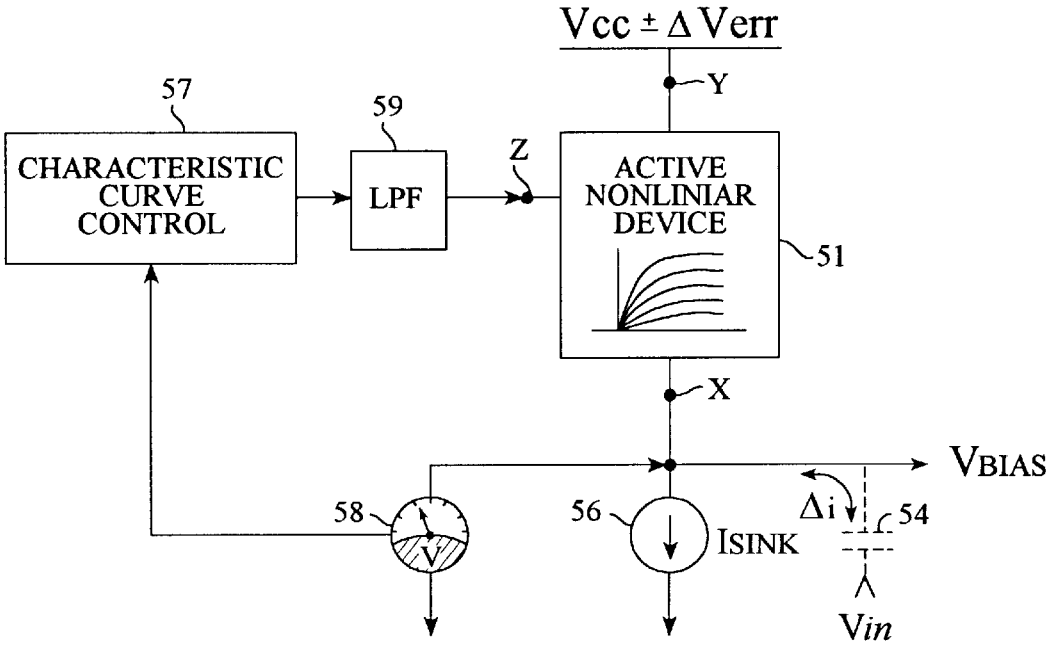
FIG. 11 is a circuit block of a second embodiment of the present invention.

With reference to FIG. 11, a second embodiment of the present invention takes advantage of the nonlinearity of the current to voltage relation in the saturation region of active nonlinear device 51. As explained above, the saturation region of active nonlinear device 51 is characterized by large voltage fluctuations in response to small current variations. The second embodiment takes advantage of this transistor action to indirectly monitor current variations through active nonlinear device 51 by monitoring $V_{XY}$ voltage fluctuations. Although this can be done by monitoring the voltage drop across nodes X and Y, the second embodiment instead monitors only node Y with respect to ground. This permits the second embodiment to address a second source of $V_{BIAS}$ voltage error not addressed in the previous embodiment.

The second source of voltage error results from variations in the power supply Vcc. As explained above, the previous embodiment of the present invention maintains a relatively vertical load line applied to active nonlinear device 51. This means that the voltage $V_{XY}$ across active nonlinear device 51 remains relatively constant at some predetermined value Q* regardless of current fluctuations. Since $V_{XY}$ is Vcc less the voltage at node Y and $V_{XY}$ remains constant, the voltage at node Y also remains constant over current fluctuations as long as power supply Vcc remains constant. But if an error voltage ΔVerr is introduced into power supply Vcc, the same error voltage ΔVerr will be reflected at node Y. This would introduce at voltage error ΔVerr at output node $V_{BIAS}$ despite $V_{XY}$ remaining constant at Q*. By monitoring the voltage at node Y, however, the second embodiment of the present invention not only addresses the problem of error current Δi introduced by input signal Vin, but also monitors for and responds to voltage errors caused by power fluctuations ΔVerr.

In the present embodiment of FIG. 11, the current drain shown as a resistor 55 in FIG. 8 is instead implemented as a temperature and power insensitive current sink $I_{SINK}$ 56. Active nonlinear device 51 is placed in series with $I_{SINK}$ 56 between Vcc and ground. As shown, power supply Vcc of FIG. 11 is suspectible to power fluctuations ±ΔVerr.

Input signal Vin is again coupled to output node $V_{BIAS}$ and node Y by means of coupling capacitor 54. A voltage monitoring means 58 is coupled between node Y and ground. Voltage monitoring means 58 has an output signal coupled to characteristic curve control 57, which monitors for AC fluctuations at node Y. Assuming that Vcc is constant, voltage fluctuations at node Y would mean that active nonlinear device 51 is experiencing error current Δi fluctuations. Characteristic curve control 57 would respond to the AC voltage fluctuations by transmitting a control signal via low pass filter 59 to input node Z of active nonlinear device 51 to maintain a vertical load line applied to device 51. As explained above, control signal Z is modulated to cycle through available characteristic curves of device 51 until the voltage $V_{XY}$ is returned to its initial position. In this case, since fluctuations in $V_{XY}$ are indirectly monitored by noting voltage fluctuations at node Y, control signal Z is modulated until the voltage at node Y is returned to its initial position. Assuming Vcc is constant, this would restore the voltage $V_{XY}$ to its initial value of Q* and restore the voltage at node Y to its initial value of Vcc−Q*. The embodiment of FIG. 11 thus reproduces the response of the circuit of FIG. 8.

If, on the other hand, one assumes that there is no error current, Δi=0 through active nonlinear device 51, but Vcc instead experiences power fluctuations ΔVerr, then node Y would fluctuate with ΔVerr. Again, voltage monitoring means 58 transmits this voltage fluctuation to characteristic curve control 57, which in turn transmits a modulating control signal via low pass filter 59 to control input Z. This selects a new characteristic curve for active nonlinear device 51 to return the voltage at node Y to its initial value despite the power fluctuation ΔVerr. The resultant voltage across nodes X and Y may not necessarily be equal to the initial voltage drop Q*. In effect, the vertical load line applied to nonlinear device 51 is shifted to a new operating point, as more fully explained below.

For example, assume that the desired $V_{XY}$ voltage of Q* is maintain constant across nodes X and Y. $V_{BIAS}$*, the desired bias voltage output, is defined as $$V_{BIAS}^{*}=Vcc-Q^{*}$$

If, a power fluctuation introduces an error voltage ΔVerr into Vcc, the new bias voltage $V_{BIAS}$' will be $$\begin{aligned} V_{BIAS}' &= (Vcc \pm \Delta Verr) - Q^{*} \\ &= Vcc - Q^{*} \pm \Delta Verr \\ &= V_{BIAS}^{*} \pm \Delta Verr \end{aligned}$$

such that the desired output $V_{BIAS}$* will reflect the error voltage ΔVerr. To compensate for this power voltage error, characteristic curve control 57 shifts the vertical load line of active nonlinear device 51 to a new quiescent value Q' by an equal amount ΔVerr. For example, assume that a negative −ΔVerr is added to Vcc such that the new bias output $V_{BIAS}$' is $$V_{BIAS}'=(Vcc-\Delta Verr)-Q^{*}$$

Characteristic curve control 57 would respond by shifting the vertical load of nonlinear device 51 from $V_{XY}$=Q* to a new value offset by an amount −ΔVerr. In other words, the new quiescent value Q' is equal to the initial value of Q* and a shift of −ΔVerr such that $$\begin{aligned} V_{BIAS}' &= (Vcc - \Delta Verr) - (Q^{*} - \Delta Verr) \\ &= (Vcc - \Delta Verr - Q^{*} + \Delta Verr) \\ &= Vcc - Q^{*} \\ &= V_{BIAS}^{*} \end{aligned}$$

As seen, the new voltage drop of Q'=(Q*−ΔVerr) is sufficient to restore the voltage at node Y, i.e. the output bias voltage $V_{BIAS}$' to its initial value of $V_{BIAS}$*.

Figure 12:
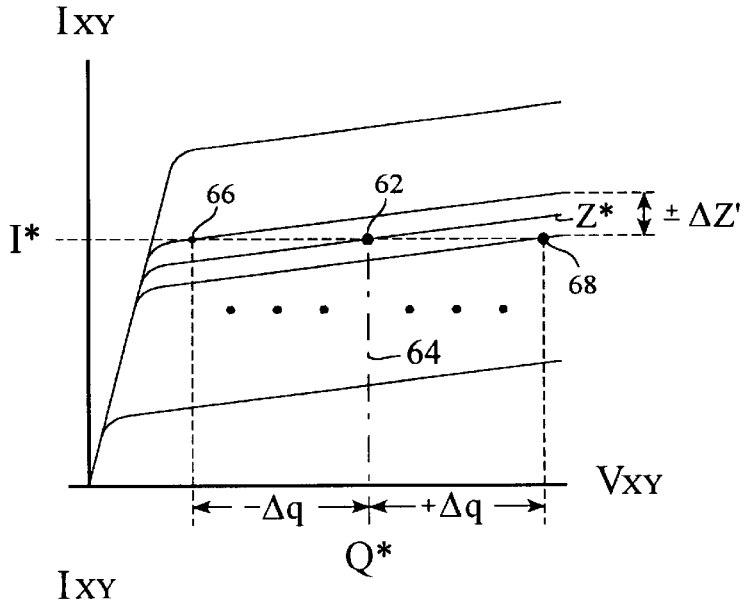
FIGS. 12–14 are graphical representations of a secondary function of an element within FIGS. 8 and 11.

FIG. 12 is a graphical depiction of how the second embodiment of the present invention addresses Vcc power fluctuations. A quiescent operating point 62 is found at the intersection of an initial constant current I* and a selected characteristic curve Z* resulting in a predetermined $V_{XY}$ voltage drop of Q*. If it is assumed that no error current Δi is introduced and I* therefore remains constant, one can more easily discuss in isolation the response of the circuit of FIG. 11 to power error fluctuations ±ΔVerr. As shown, introducing a small modulation ±ΔZ' into control input Z* can shift vertical load line 64 from operating point 66 to operating point 68 to point 74 resulting in a controlled voltage shift over a large range of Q*±Δq. Deviations in power supply Vcc may be transient in nature or result from a gradual loss of power such as the natural aging of a battery. Due to the large $V_{XY}$ response to small Z modulations, the circuit can quickly respond to power transients as well as to the gradual degradation of a power supply.

Figure 13:
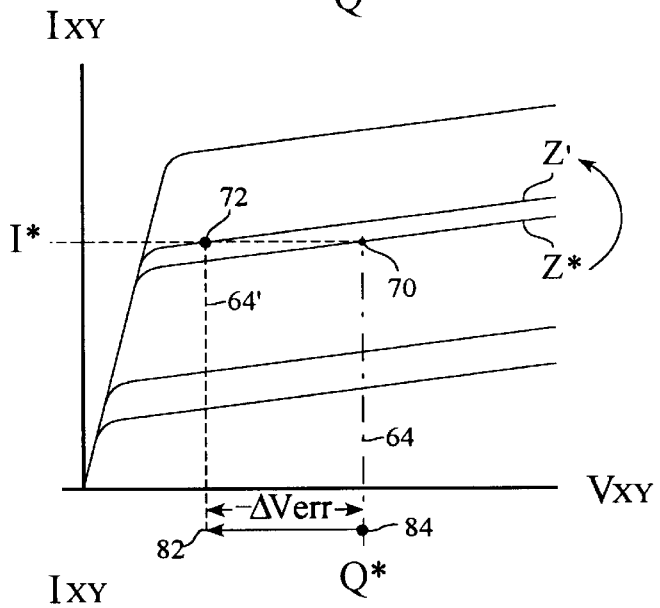

With reference 13, a first operational example of the circuit of FIG. 11 responding to power fluctuation in Vcc is shown. In FIG. 13, it is assumed that no error currents Δi are being introduced by capacitively coupled input Vin such that current I* remains constant. It is further assumed that an initial control input of Z* places device 51 at operating point 70 having a quiescent voltage drop of Q*. Assuming that Vcc receives a negative power fluctuation of ±ΔVerr, characteristic curve control 57 of FIG. 11 would respond by shifting vertical load line 64 from an initial position at point Q* downward by an equal amount −ΔVerr to a new position Q'. This is accomplished by modulating the control input of active nonlinear device 51 from Z* to a new characteristic curve Z'. This shifts the operating point from point 70 to point 72 and reduces the voltage drop across nodes X and Y by an amount of −ΔVerr to a new Q'. As explained above, this new value is sufficient to restore the voltage at node Y to its initial value.

The new quiescent operating point of Q' is then held constant as long as no new power fluctuations are experienced. Vertical load line 64 is thus shifted to a new location 64'. That is, if the power supply were to remain at Vcc−ΔVerr while an input signal Vin were to introduce current fluctuations Δi, then the circuit of FIG. 11 would respond to maintain the voltage drop across nodes X and Y at Q', as explained above with reference to FIGS. 8–10.

Figure 14:
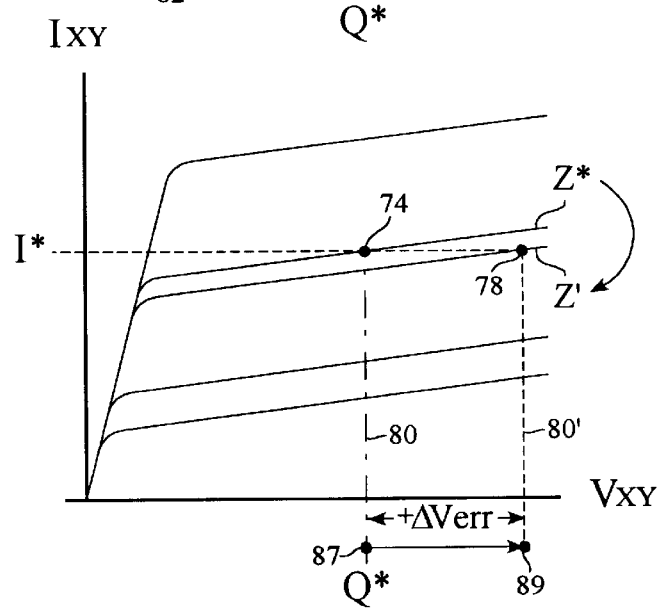

With reference to FIG. 14, a second operational example assumes Vcc receives a positive voltage fluctuation of +ΔVerr. The circuit of FIG. 11 again responds by modulating the control input from Z* to Z' and thereby shifts vertical load line 80 by an equal amount +ΔVerr from operating point 74 to operating point 78. This creates a new quiescent operating value Q' which is then maintained constant as long as the power supply does not change. If the power supply were to return to its initial value of Vcc, then the circuit of FIG. 11 would again return the voltage drop across nodes X and Y to its initial value of Q* by returning the control input of nonlinear device 51 to its initial characteristic curve Z*.

As seen from the above, the present circuit responds to two different sources of error. In the first case, the present invention can maintain a vertical load line across a nonlinear device such that the voltage drop $V_{XY}$ across it is impervious to current error fluctuations Δi. In this way, it becomes immune to current fluctuations introduced by a capacitively coupled input signal Vin. In the second case, by monitoring one node of nonlinear device 51, the circuit can additionally correct for power fluctuations in Vcc by continuously shifting the desired voltage drop Q' across nonlinear device 51 and maintaining a vertical load line at that new voltage drop Q' to compensate for power fluctuations.

Figure 15:
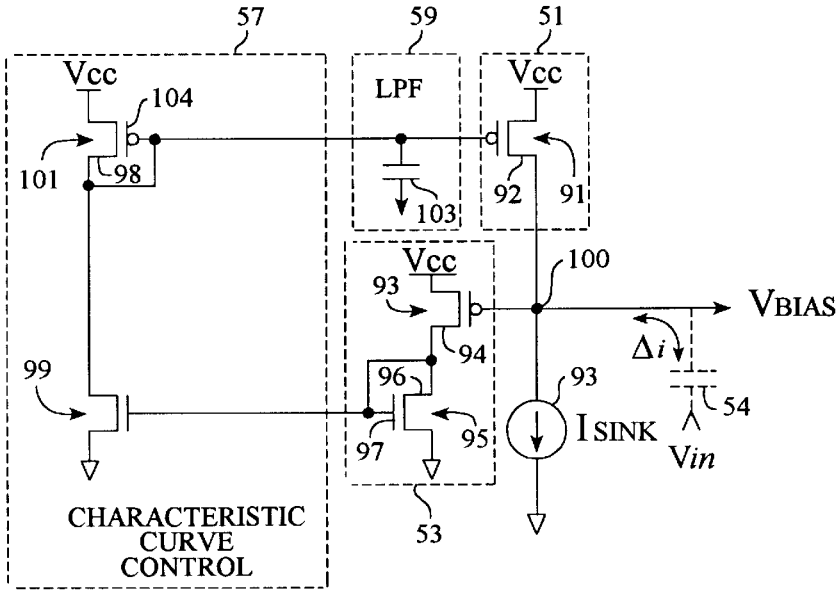
FIG. 15 is a circuit implementation of the circuit blocks of FIGS. 8 and 11.

With reference to FIG. 15, a CMOS implementation of the present invention is shown. In the present implementation, active nonlinear device 51 of FIGS. 8 and 11 is implemented as a pmos transistor 91 in FIG. 15. Pmos transistor 91 has its drain electrode 92 coupled to a current sink 93 such that pmos transistor 91 is in series with current sink 93 between Vcc and ground. Constant bias voltage $V_{BIAS}$ is tapped off of node 100 at the junction of drain electrode 92 and current sink 93. An input signal Vin is coupled to node 100 via an intrinsic capacitance 54. Pmos transistor 91 is operated in its saturation regions and, as explained above, experiences large $V_{DS}$ voltage fluctuations over small $I_{DS}$ current fluctuations. It is because of this behavior that transistors in the saturation region have traditionally been used as current sources, but have not made good voltage sources. Nonetheless, because of this heightened voltage sensitivity to current change, the present implementation indirectly monitors current fluctuations through transistor 91 by noting the resultant voltage fluctuations at node 100. Thus, the circuit of FIG. 15 follows the second embodiment of the present invention shown in FIG. 11, Within error detecting sub-circuit 53, a second pmos transistor 93 has its gate coupled to node 100 and its drain electrode 94 coupled to a drain electrode 96 of an nmos transistor 95. Pmos transistor 93 and nmos transistor 95 are connected in series between Vcc and ground. Voltage fluctuations at the gate of pmos transistor 93 result in current fluctuations in transistor 93. The current through transistor 93 effectively becomes a measure of current fluctuations through transistor 91. Transistor 95 has its control gate 97 coupled to its drain electrode 96 such that it will in turn develop a gate voltage representative of the current through transistor 93. The gate voltage of transistor 95 is then mirrored onto characteristic curve control 57.

Characteristic curve control 57 is implemented by means of a third pmos transistor 101 in series with a second nmos transistor 99, both connected in series between Vcc and ground. The drain 98 of pmos transistor 101 is coupled to its gate 104. Thus, the voltage measure at gate 97 of current fluctuations through node 100 are transmitted to characteristic curve control 57, and the current through transistors 99 and 101 is adjusted accordingly. Transistor 101 develops a compensating voltage at its gate and transmits it via a low pass filter 59, consisting of a capacitor 103, to the gate of pmos transistor 91.

The polarity of voltage and current fluctuations of nonlinear device 51 will depend on the type of device (pmos, nmos etc.) used to implement element 51. For the sake of brevity, the following discussion will refer only to the magnitude of voltage and current fluctuations. Interpretation of the correct polarities for a given device type is considered to be within the scope of the typical person versed in the art.

Assuming Vcc is constant, a voltage rise at node 100 corresponds to a drop in the magnitude of the source to drain voltage, $V_{DS}$, across transistor 91. In turn, a drop in the $V_{DS}$ voltage of transistor 91 corresponds to a magnitude drop in its source to drain current $I_{DS}$. Similarly a drop in voltage at node 100 corresponds to an increase in the magnitude of the $V_{DS}$ voltage of transistor 91 and to an increase in the $I_{DS}$ current through transistor 91. Thus, a decrease in current through transistor 91 manifests itself as a rise in voltage at node 100, and an increase in current through transistor 91 manifests itself as a decrease in voltage at node 100.

With reference to FIGS. 9 and 15, assume that the family of curves portrayed in FIG. 9 define the characteristic behavior of transistor 91. Further assume that current magnitudes $I_{DS}$ through transistor 91 are identified as current values $I_{XY}$ in FIG. 9, and that voltage magnitudes $V_{DS}$ across transistor 91 are indicated as voltage values $V_{XY}$ in FIG. 9. Current $I_{XY}$ through transistor 91 is the sum of current $I_{SINK}$ through current sink 93 plus any error current Δi introduced by capacitively coupled input signal Vin as follows, $$I_{XY}=I_{SINK}\pm\Delta i$$

Assume that input signal Vin is initially not applied and thus no error current is introduced, Δi=0. If characteristic curve control 57 applies an initial control voltage of Z1* to the gate of transistor 91 and constant current sink 93 has a current magnitude defined by point 63, this would establish a quiescent voltage drop ($V_{XY}$) of value Q* across the source to drain electrodes of transistor 91.

If input signal Vin is then applied and it injects an error current Δi into node 100, this would result in a reduction of −Δi in the $I_{DS}$ current of transistor 91. Its $V_{DS}$ voltage would tend to respond by decreasing toward point 69. The reduction in the $V_{DS}$ of transistor 91 would result in a voltage rise at node 100, as explained above.

Sub-circuit 58 responds to the voltage rise at node 100 by reducing the current sourcing capability of transistor 93. Because of the reduced current through transistor 93, transistor 95 can pull downward the potential at its gate. This lower potential is mirrored onto transistor 99 of characteristic curve control 57. The lowered potential at the gate of transistor 99 causes it to lower its current sourcing capability. Transistor 101 responds to the reduced current through transistor 99 by raising the voltage at its control gate 104. This rise in voltage is transferred via low pass filter 59 to the control gate of transistor 91. As the voltage at the control gate of transistor 91 rises, the magnitude of its source-to-gate voltage $V_{DS}$ falls to a new value Z3. The lower $V_{GS}$ voltage of Z3 increases its $V_{DS}$ voltage magnitude back to its original value of Q* while maintaining the new current of $I_{DS}=I_{SINK}-\Delta i$.

With reference to FIGS. 10 and 15, if on the other hand, one assumes that input signal Vin drew an error current Δi away from node 100, this would result in an increase of +Δi in the $I_{DS}$ current of transistor 91. As a result, the $V_{DS}$ voltage of transistor 91 would tend to respond by increasing from an initial value Q* at point 79 toward point 83. The increase in the magnitude of $V_{DS}$ across transistor 91 would result in a voltage drop at node 100, as explained above.

Sub-circuit 53 responds to the voltage drop at node 100 by increasing the current sourcing capability of transistor 93. Transistor 93 than pulls upward the potential at the gate of transistor 95. This higher potential is mirrored onto transistor 99 of characteristic curve control 57. The higher potential at the gate of transistor 99, causes it to increase its current sourcing capability and thereby pull downward the potential at gate 104 of transistor 101. This drop in voltage is transferred via low pass filter 59 to the control gate of transistor 91. As the voltage at the control gate of transistor 91 drops, the magnitude of its $V_{GS}$ voltage is increased to a new value Z3. The higher $V_{GS}$ voltage of Z3 decreases the $V_{DS}$ voltage of transistor 91 back towards its original value of Q* while maintaining the new current of $I_{DS}=I_{SINK+\Delta i}$.

In the previous two operational examples of the circuit of FIG. 15, it was assumed that Vcc remained constant. As a result, voltage fluctuations at node 100 were due only to $V_{DS}$ fluctuations across transistor 91 caused by the introduction of error current Δi by capacitively coupled input signal Vin. Therefore, the $V_{DS}$ across transistor 91 was maintained relatively constant by actively modulating the control input Z of transistor 91 to maintain the voltage at node 100 constant. In other words, the $V_{DS}$ of transistor 91 was restored to its initial value by restoring the voltage at node 100 to its initial value. Thus, circuit blocks 57, 58 and 59 modulate the gate of transistor 91 in response to voltage fluctuations at node 100, regardless of how these fluctuations are caused. If, for example, voltage fluctuations at node 100 were introduced by fluctuations in Vcc, the present invention would again adjust transistor 91, as explained with reference to FIGS. 12–14, to restore the voltage at node 100 back to its initial steady-state value. Therefore, if voltage fluctuations at node 100 were caused not by error current Δi, but rather by power fluctuation in Vcc, then voltage monitoring means 58 would respond to these fluctuations by transmitting a measure of the voltage fluctuations to characteristic curve control 57. Sub-circuit 57 would then respond by modulating the control gate of transistor 91 and shifting its vertical load line to a new operating point until the voltage at node 100 was returned to its initial value. In the case of voltage fluctuations at node 100 being due to both power fluctuations and the introduction of error current Δi, the circuit of FIG. 15 would respond to both errors simultaneously and adjust node 100 to its initial value once again.

Figure 16:
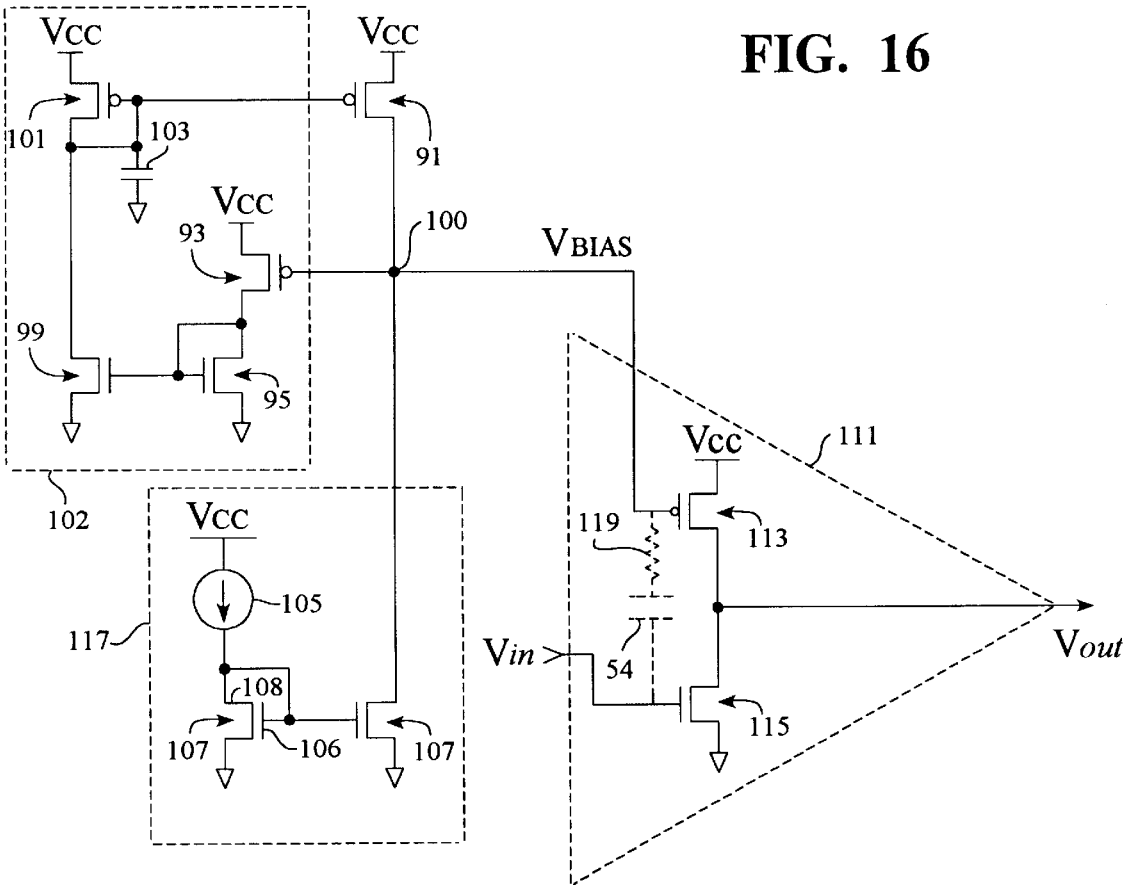
FIG. 16 is a voltage amplifier incorporating the circuit structure of FIG. 15.

With reference to FIG. 16, an AC signal amplifier incorporating the preferred embodiments of the present invention is shown. For the sake of clarity, all elements having a similar function as those of FIG. 15 are identified by similar reference characters as in FIG. 15 and are explained above. Input signal Vin is applied to a voltage amplifier 111 having an output signal Vout. Internally, voltage amplifier 111 consists of pmos transistor 113 and nmos transistor 115 connected in series between Vcc and ground, with Vout tapped at the drains of both transistors 113 and 115. Input signal Vin is coupled to the control gate of transistor 115, and transistors 113 functions as a constant current source to establish a predetermined load line and gain for amplifier 111. Transistor 113 has a quiescent current value determined by constant control signal $V_{BIAS}$. Input signal Vin is shown to also be coupled to the control gate of pmos transistor 113 and to $V_{BIAS}$ by means of intrinsic capacitor 54.

Control signal $V_{BIAS}$ is generated by means of pmos transistor 91, circuit block 117 and circuit block 102. The source of pmos transistor 91 is coupled to Vcc and its drain is connected to circuit block 117 at node 100. Circuit block 117 is a preferred implementation of a power and temperature insensitive current sink, and it preferably establishes a steady state current value sufficient to place pmos transistor 91 in its saturation mode of operation. Current sink 117 consists of a constant current source 105 coupled between Vcc and transistor 107. The drain 108 of transistor 107 is coupled to its control gate 106 such that it generates a source-to-gate voltage dependent on the value of current source 105. The source-to-gate voltage of transistor 107 is mirrored onto transistor 107, which establishes a current path from node 100 to ground.

Circuit block 102 incorporates sub-circuits 57, 53 and 59 identified in FIG. 15. As shown in FIG. 16, the voltage at node 100 is monitored at the gate of pmos transistor 93, which captures a measure of the source-to-drain current through transistor 91 and fluctuations in Vcc, as explained above. A current through transistor 93 is mirrored via transistor 95 onto transistor 99. In response to the current through transistor 99, transistor 101 establishes a compensating voltage, which it transfers via a low pass filter consisting of capacitor 103 to the control gate of pmos transistor 91. In this way, circuit block 102 monitors both error current Δi through transistor 91 and power fluctuations in Vcc, and adjusts the operating point of transistor 91 in such a manner as to maintain the voltage at node 100 constant. In effect, circuit block 102 establishes a shiftable vertical load line for transistor 91. $V_{BIAS}$ therefore remains relatively constant over a large range of power fluctuations in Vcc and current fluctuations introduced by input signal Vin. Since voltage $V_{BIAS}$ at the gate of transistor 113 remains relatively unaffected by Vin, the circuit behaves as if there were a very high impedance 119 separating capacitor 54 from $V_{BIAS}$ and the control gate of transistor 113. The present invention thus achieves an effective high impedance node and a constant $V_{BIAS}$ at node 100 using only active devices and eliminating the need for large resistors.

I claim:

1. A constant voltage source having an output voltage node and further comprising:

a first power rail and a second power rail;

means for establishing a reference current;

an active nonlinear device having a first node, a second node and a control input, said active nonlinear device being characterized by a family of current versus voltage (I–V) curves, each of said I–V curves relating a device current through said first and second nodes to a device voltage across said first and second nodes, said control input selecting one of said I–V curves, said active nonlinear device being maintained in a saturation mode of operation;

said means for establishing a reference current and said active nonlinear device being coupled in series between said first and second power rails whereby a predetermined voltage is generated across said first and second nodes in accordance to said reference current and a first I–V curve, said first node being said output voltage node;

current monitoring means for detecting a deviation current through said first and second nodes, said deviation current comprising a sum of said reference current and an error current;

feedback means responsive to said current monitoring means and coupled to said control input, said feedback means modulating said control input to operate said active nonlinear device in accordance with a second I–V curve, said deviation current corresponding to said predetermined voltage via said second I–V curve whereby a substantially vertical load line is established at said predetermined voltage.

2. The constant voltage source of claim 1 wherein said active nonlinear device is one of a BJT transistor, JFET transistor and MOS transistor.

3. The constant voltage source of claim 1 further comprising a power monitoring means for detecting an error voltage in said first and second power rails, said feedback means also being responsive to said power monitoring means to operate said active nonlinear device in accordance with a third I–V curve wherein said predetermined voltage is shifted by a magnitude substantially equal to said error voltage.

4. The constant voltage source of claim 1 further comprising means for coupling an input signal to said output voltage node, said input signal generating said error current.

5. The constant voltage source of claim 1 wherein said current monitoring means comprising a voltage monitoring means coupled across said first node and one of said first and second power rails whereby current fluctuations through said nonlinear device are indirectly detected by said voltage monitoring means as consequent voltage fluctuations across said first and second nodes.

6. The constant voltage source of claim 5 wherein said active nonlinear device is one of a BJT transistor, JFET transistor and MOS transistor.

7. The constant voltage source of claim 5 wherein said second node is connected to one of said first and second power rails whereby the voltage at said first node fluctuates with both said error current through said active nonlinear device and with an error voltage in Vcc.

8. The constant voltage source of claim 7 wherein said voltage monitoring means includes a first and second MOS transistor, said first MOS transistor having a first source electrode a first drain electrode and a first control gate, said second MOS transistor having a second source electrode, a second drain electrode and a second control gate;

said first and second MOS transistors being coupled in series between said first and second power rails with said first source electrode being coupled to one of said first and second power rails, said first control gate being coupled to said output voltage node, said second drain electrode being coupled to said second control gate whereby a measure voltage of voltage fluctuations at said output voltage node is generated at said second control gate.

9. The constant voltage source of claim 8 wherein said said feedback means includes a third and fourth MOS transistor, said third MOS transistor having a third source electrode, a third drain electrode and a third control gate, said fourth MOS transistor having a fourth source electrode, a fourth drain electrode and fourth control gate, said third and fourth MOS transistors being coupled in series between said first and second power rails with said third source electrode being coupled to one of said first and second power rails, said fourth control gate receiving said measure voltage and said third control gate being coupled to said third drain electrode whereby a compensation voltage is generated at said third control gate, said compensating voltage being applied to said control input of said nonlinear device.

10. The constant voltage source of claim 9 wherein said compensation voltage is applied to said control input via a low pass filter.

11. The constant voltage source of claim 10 wherein said low pass filter includes a capacitor coupled between said control input and one of said first and second power rails.

12. The constant voltage source of claim 7 further including a means for coupling an input signal to said output voltage node, said input signal being effective for producing said error current.

13. The constant voltage source of claim 12 wherein said means for coupling an input signal is a coupling capacitor.

14. The constant voltage source of claim 13 wherein said coupling capacitor is an intrinsic capacitor.

15. A constant voltage source having an output voltage node and further comprising:

a first power rail and a second power rail;

means for establishing a reference current;

a first MOS transistor having a first source electrode coupled to said first power rail, a first drain electrode and a first control gate, said first MOS transistor characterized by a family of I–V curves;

said means for establishing a reference current and said first MOS transistor being coupled in series between said first and second power rails whereby said reference current establishes predetermined voltage drop across the source to drain electrodes of said first MOS transistor in accordance with a first I–V curve, said first drain electrode being said output voltage node;

ac monitoring means for detecting an error current through said first MOS transistor, said ac monitoring means being coupled to said first drain electrode;

a characteristic curve control circuit responsive to said ac monitoring means and having a curve select output coupled to said first control gate, said characteristic curve control circuit being effective for modulating the channel conductance of said first MOS transistor to establish a second voltage across the source to drain electrodes of said first MOS transistor in accordance with a second I–V curve in response to a sum of said reference current and said error current through said first MOS transistor, said second voltage being substantially equal to said predetermined voltage whereby a substantial vertical loadline is maintained at said predetermined voltage drop; and a coupling capacitor for coupling an input signal to said output voltage node, said input signal being effective for producing said error current.

16. The constant voltage source of claim 15 wherein said first MOS transistor is constantly maintained in a saturation mode of operation.

17. The constant voltage source of claim 15 wherein said ac monitoring means includes a second and third MOS transistors, said second MOS transistor having a second source electrode, a second drain electrode and a second control gate, said third MOS transistor having a third source electrode, a third drain electrode and a third control gate, said second and third MOS transistors being coupled in series between said first and second power rails, said second control gate coupled to said voltage output node, said third control gate coupled to said third drain electrode whereby said ac monitoring means can further monitor an error voltage in said first and second power rails, said third control gate generating a measure voltage dependent on both current fluctuations through said first MOS transistor and on said error voltage in said power rails.

18. The constant voltage source of claim 17 wherein one of said second and third MOS transistors is an pmos device and the other is an nmos device.

19. The constant voltage source of claim 17 wherein said third control gate is coupled to said characteristic curve control circuit.

20. The constant voltage source of claim 15 wherein said characteristic curve control circuit includes;

a fourth MOS transistor having a fourth source electrode, a fourth drain electrode and a fourth control gate;

a fifth MOS transistor having a fifth source electrode, a fifth drain electrode and fifth control gate;

said fourth and fifth MOS transistors coupled in series between said first and second power rails, said fourth control gate coupled to said ac monitoring means, said fifth control gate coupled to said fifth drain electrode, said fifth control gate further being said curve select output coupled to said first control gate.

21. The constant voltage source of claim 20 wherein one of said fourth and fifth transistors is a pmos device and the other is an nmos device.

22. The constant voltage source of claim 15 wherein said curve select output is coupled said first control gate via a low pass filter.

23. The constant voltage source of claim 22 wherein said low pass filter includes a capacitor coupled from said curve select output to one of said first and second power rails.

24. The constant voltage source of claim 15 wherein said coupling capacitor is an intrinsic capacitor.

25. A constant voltage source having an output voltage node and further comprising:

a first power rail and a second power rail;

a current source producing a reference current;

a first MOS device having a first source electrode coupled to said first power rail, a first drain electrode and a first control gate, said first MOS device being characterized by a family of current $I_{DS}$ versus voltage $V_{DS}$ curves;

said current source and said first MOS device coupled in series between said first and second power rails whereby a predetermined voltage is established across said first source and drain electrodes accordance to said reference current and a first $I_{DS}$ vs. $V_{DS}$ curve, said first drain electrode being said output voltage node;

means for coupling an input signal to said output voltage node, said input signal being effective for establishing a deviation current through said first MOS device, said deviation current comprising the sum of said reference current and an error current;

current monitoring means for detecting said deviation current;

a characteristic curve control circuit responsive to said current monitoring means and having a curve select output coupled to said first control, said characteristic curve control circuit being effective for modulating the channel conductance of said first MOS transistor to a second $I_{DS}$ vs. $V_{GS}$ curve, said deviation current corresponding to said predetermined voltage via said second $I_{DS}$ vs. $V_{GS}$ curve whereby a substantially vertical load line is established at said predetermined voltage.

26. The constant voltage source of claim 1 wherein said first MOS device is constantly maintained in a saturation mode of operation.

27. The constant voltage source of claim 25 wherein said current monitoring means includes;

a second MOS device having a having a second source electrode, a second drain electrode and a second control gate, said second control gate being coupled to said output voltage node;

a said third MOS device having a third source electrode, a third drain electrode and a third control gate, said third control gate coupled to said third drain electrode;

said second and third MOS devices being coupled in series between said first and second power rails whereby said ac monitoring means can further monitor for an error voltage in said first and second power rails, said third control gate generating a measure voltage dependent on both current fluctuations through said first MOS device and on said error voltage in said power rails, said third control gate being coupled to said characteristic curve control circuit.

28. The constant voltage source of claim 27 wherein said characteristic curve control circuit includes;

a fourth MOS transistor having a fourth source electrode, a fourth drain electrode and a fourth control gate, said fourth control gate coupled to said third control gate;

a fifth MOS transistor having a fifth source electrode, a fifth drain electrode and fifth control gate, said fifth control gate coupled to said fifth drain electrode;

said fourth and fifth MOS transistors being coupled in series between said first and second power rails, said fifth control gate further being said curve select signal coupled to said first control gate, said characteristic curve control circuit being further responsive to said measure voltage to operate said first MOS device in accordance with a third $I_{DS}$ vs. $V_{DS}$ curve wherein said predetermined voltage is shifted by a magnitude substantially equal to said error voltage.

29. The constant voltage source of claim 28 wherein one of said second and third MOS devices is a pmos device and the other is an nmos device, and wherein one of said fourth and fifth devices is a pmos device and the other is an nmos device.

30. The constant voltage source of claim 28 wherein said said fifth control gate is coupled to said first control gate via a low pass filter.

31. The constant voltage source of claim 30 wherein said low pass filter includes a capacitor coupled from said fifth control gate to one of said first and second power rails.

32. The constant voltage source of claim 28 wherein said means for coupling an input signal is a coupling capacitor.

33. The constant voltage source of claim 32 wherein said coupling capacitor is an intrinsic capacitor.

34. The constant voltage source of claim 28 wherein said first MOS device is a pmos transistor.

* * * * *